United States Patent [19]

Holmes

[11] Patent Number: 4,598,772

[45] Date of Patent: Jul. 8, 1986

[54] METHOD FOR OPERATING A PRODUCTION WELL IN AN OXYGEN DRIVEN IN-SITU COMBUSTION OIL RECOVERY PROCESS

[75] Inventor: Billy G. Holmes, Lancaster, Tex.

[73] Assignee: Mobil Oil Corporation, New York, N.Y.

[21] Appl. No.: 566,373

[22] Filed: Dec. 28, 1983

[51] Int. Cl.[4] ..... E21B 43/243; E21B 47/06

[52] U.S. Cl. ..... 166/251; 166/53; 166/64; 166/261

[58] Field of Search ..... 166/53, 57, 64, 251, 166/256, 261, 263, 302

[56] References Cited

U.S. PATENT DOCUMENTS

| | | | |
|---|---|---|---|
| 3,202,219 | 8/1965 | Parker | 166/53 |
| 3,240,270 | 3/1966 | Marx | 166/251 |
| 3,406,755 | 10/1968 | Sharp | 166/251 X |
| 3,454,365 | 7/1969 | Lumpkin et al. | 166/251 X |
| 3,470,954 | 10/1969 | Hartley | 166/53 X |
| 4,450,910 | 5/1984 | Hunt, III | 166/261 |
| 4,474,237 | 10/1984 | Shu | 166/261 |

*Primary Examiner*—George A. Suchfield
*Attorney, Agent, or Firm*—Alexander J. McKillop; Michael G. Gilman; Charles J. Speciale

[57] ABSTRACT

A method for operating a production well during an oxygen driven in-situ combustion oil recovery process comprising continuously injecting an inert gas such as nitrogen or carbon dioxide into the bottom of the production well at a predetermined low injection rate, preferably 0.1 to 2 MSCF/day, and continuously monitoring the oxygen concentration of the produced effluent gas and the bottomhole temperature of the production well. In the event that the oxygen content of the effluent gas increases to a value within the range of 5 to 20 volume percent or the bottomhole temperature of the production well increases to a value within the range of 200° to 300° F., the injection rate of the inert gas into the bottom of the production well is increased to a maximum rate until the oxygen concentration of the effluent gas and the bottomhole temperature are reduced to a safe level.

8 Claims, 1 Drawing Figure

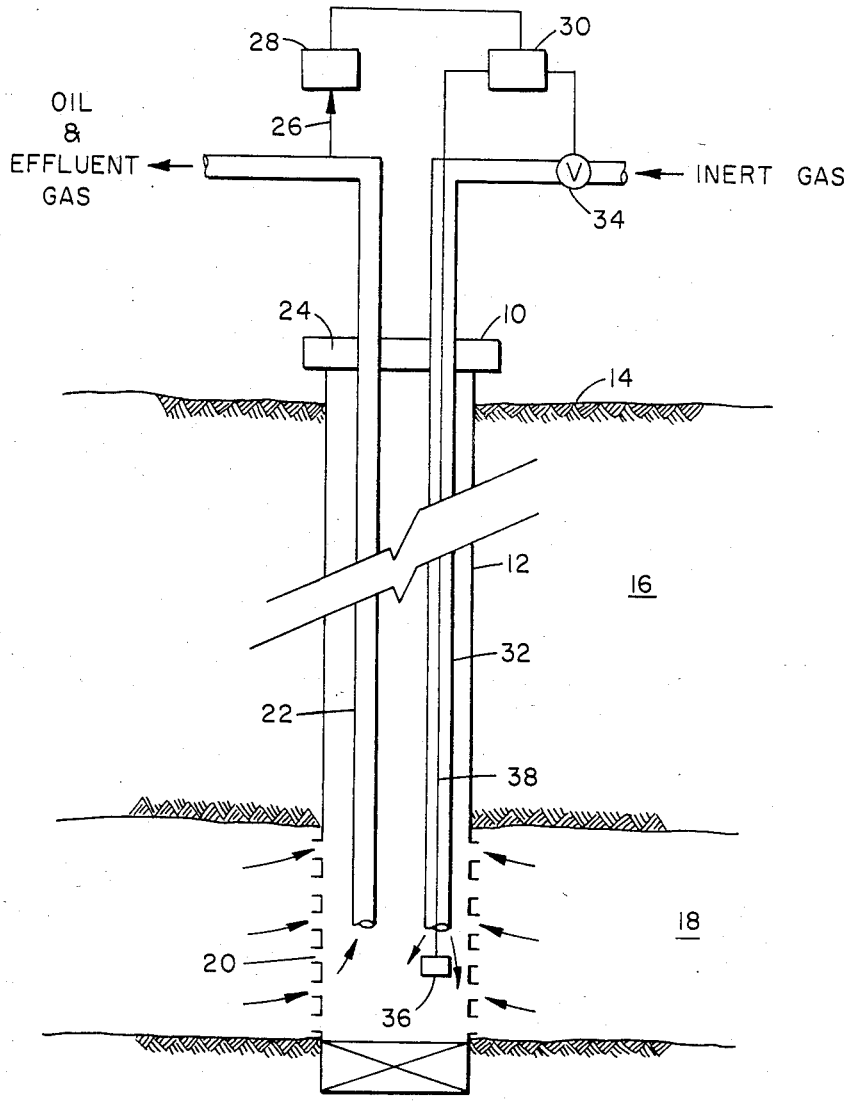
28
30
OIL
&
EFFLUENT
GAS
26
V
INERT GAS
34
24
10
14
12
16
32
22
38
18
20
36

METHOD FOR OPERATING A PRODUCTION WELL IN AN OXYGEN DRIVEN IN-SITU COMBUSTION OIL RECOVERY PROCESS

BACKGROUND OF THE INVENTION

This invention relates to an in-situ combustion recovery process within a subterranean, oil-containing formation using high concentrations of oxygen and more particularly to a method for operating a production well in such processes wherein a small amount of an inert gas is continuously injected into the bottom of the well which may be increased to a maximum rate if either the bottomhole temperature of the well or the oxygen content of the effluent gas from the well reach an unsafe level indicating a hazardous condition in the well.

Thermal recovery techniques, in which hydrocarbons are produced from carbonaceous strata such as oil sands, tar sands, oil shales, and the like by the application of heat thereto, are becoming increasingly prevalent in the oil industry. Perhaps the most widely used thermal recovery technique involves in-situ combustion or "fire flooding". In a typical fire flood, a combustion zone is established in a carbonaceous stratum and propagated within the stratum by the injection of air, oxygen-enriched air or pure oxygen through a suitable injection well. As the combustion supporting gas is injected, products of combustion and other heated fluids in the stratum are forced away from the point of injection toward production zones where they are recovered from the stratum and withdrawn to the surface through suitable production wells. U.S. Pat. Nos. 3,240,270-Marx, 4,031,956-Terry, and 4,042,026-Pusch et al are examples of the recovery of oil by in-situ combustion.

In such processes, the prevention of unintended ignition due to the hazardous nature of using pure oxygen is of primary concern. For example, as the combustion zone moves away from the injection well, a large volume of unreacted oxygen sometimes accumulates near the well. If this travels upwardly in the well, a catastrophic fire possibly destroying the well, can be ignited. U.S. Pat. No. 3,125,324-Marx discusses the ignition problem. In addition, U.S. Pat. No. 4,042,026 to Pusch et al disclosed above also discusses the hazardous nature of using pure oxygen in in-situ combustion operations that could lead to uncontrolled reactions or explosions.

U.S. Pat. No. 3,240,270 to Marx discloses an in-situ combustion process for the recovery of oil wherein an inert cooling fluid such as water, nitrogen, or carbon dioxide is injected into the production boreholes so as to maintain the temperature therein below combustion supporting temperature at the oxygen concentration therein and prevent borehole fires.

U.S. Pat. No. 3,135,324 to Marx discloses an in-situ combustion process for recovery of oil wherein a fine dispersion of water is injected with the combustion supporting gas in a sufficient amount to maintain the temperature of the stratum around the injection well below ignition temperature.

It is an object of the present invention to provide a method for safely operating a production well in an in-situ combustion oil recovery operation using high concentrations of oxygen.

SUMMARY OF THE INVENTION

The present invention relates to a method for recovering viscous oil from a subterranean, viscous oil-containing formation penetrated by at least one injection well and one production well and having fluid communication therebetween comprising establishing an in-situ combustion operation in the formation by injecting substantially pure oxygen into the formation via the injection well and recovering fluids including oil and an effluent gas from the formation via the production well, continuously injecting an inert gas such as nitrogen or carbon dioxide at a predetermined low injection rate, preferably 0.1 to 2 MSCF/day, into the lower portion of the the production well, continuously analyzing the effluent gas for oxygen concentration and monitoring the bottomhole temperature of the production well, and increasing the injection rate of said inert gas to a maximum rate if the oxygen concentration of said effluent gas increases to a predetermined concentration, preferably 5 to 20 volume percent, or if the bottomhole temperature of the production well increases to a predetermined temperature, preferably within the range of 200° to 300° F.

BRIEF DESCRIPTION OF THE DRAWING

The drawing shows a completion for a production well in accordance with the present invention.

DESCRIPTION OF THE PREFERRED EMBODIMENT

The present invention provides a method for operating a production well in an oxygen driven in-situ combustion oil recovery process to prevent production well fires or downhole explosions due to the presence of an unsafe amount of oxygen in the fluids produced from the production well or a high temperature in the bottom of the well. In a conventional forward in-situ combustion operation, an oxygen-containing gas such as air, oxygen-enriched air or essentially pure oxygen is introduced into the formation via an injection well and combustion of the in-place crude adjacent the injection well is initiated by one of many known means, such as the use of a downhole gas-fired heater or a downhole electric heater or chemical means. Thereafter, the injection of the oxygen-containing gas or pure oxygen is continued so as to maintain a combustion front which is formed, and to drive the front through the formation, heating and displacing crude petroleum ahead of it toward the production well from which fluids including oil and effluent gas are recovered. If oxygen by-passes the combustion and appears in the production well, uncontrolled borehole fires or explosions could occur, especially in the case where essentially pure oxygen is utilized to support the in-situ combustion operation.

Referring to the drawing, there is shown a production well 10 provided with a casing 12 extending from the surface 14 of the earth through the overburden 16 and into an oil-containing formation 18 from which oil is recovered by an oxygen driven in-situ combustion process. The production well 10 is in fluid communication with a substantial portion of the formation 18 by means of perforations 20. A production tubing 22 extends from the bottom portion of production well 10 adjacent the formation 18 through well head 24 for recovering fluids including oil and effluent gas from the formation. A portion of the effluent gas is withdrawn from tubing 22 through line 26 and passed into a gas analysis means 28 to continuously analyze the oxygen content of the effluent gas recovered from the well. The oxygen analyzer sends signals to controller 30 in response to the oxygen content of the effluent gas.

An inert gas conduit 32 extends to a level in the bottom of the production well 10 adjacent the lower end of tubing 22. Conduit 32 passes through well head 24 and connects with a supply source of an inert gas such as nitrogen or carbon dioxide. A motor valve 34 is positioned in line 32 to control the fluid flow therein. Thermocouple 36, positioned in the bottom of production well 10 below conduit 32, sends signals via a suitable communication channel such as cable 38 to controller 30 in response to certain temperature conditions within the bottom of the well. Controller 30 functions to regulate motor valve 34 to control the amount of nitrogen or carbon dioxide injected into the bottom of the well via conduit 32 in response to the bottomhole production well temperature or the oxygen content of the effluent gas removed from tubing 22. Suspending the temperature sensing element 36 on cable 38 disposed within conduit 32 enables the sensing element to be easily replaced if it becomes inoperative.

During the in-situ combustion process, the oxygen content of the effluent gas in tubing 22 is constantly analyzed by analyzer 28 and the bottom hole temperature of the well is constantly monitored by thermocouple 36. In addition, during production, a stream of inert gas such as nitrogen or carbon dioxide is continuously injected at a predetermined low injection rate, preferably 0.1 to 2 MSCF/day, into the lower portion of the production well 10 via conduit 32. The rate of injection of inert gas through conduit 32 is controlled by motor valve 34. When the gas analysis means 28 indicates that the oxygen content of the effluent gas from production tubing 22 is within the range of 5 to 20 volume percent or when the bottomhole temperature sensed by thermocouple 36 is within the range of 200° to 300° F., controller 30 opens motor valve 34 and increases the flow rate of the inert gas to a maximum rate consistent with the pressure limitations of the formation. Production and injection of the inert gas is continued at the maximum rate until the oxygen content of the effluent gas is reduced to a safe level, preferably below 5 volume percent, and the bottomhole temperature is below 200° F. In addition, when the injection rate of the inert gas is increased to a maximum rate, the production well 10 may be shut-in and injection of oxygen into the formation via the injection well to support in-situ combustion may be terminated or reduced. Once the bottomhole temperature is below 200° F. and the oxygen content of the effluent gas from the production well is below 5 volume percent oxygen, injection of the inert gas is reduced to the predetermined low injection rate and production is continued.

Continuous injection of a small amount of inert gas into the bottom of the production well during production ensures instant availability of the gas in the event of a hazardous condition in the well.

While a particular embodiment of this invention has been shown and described, various modifications are within the true spirit and scope of the invention. The appended claims are, therefore, intended to cover all modifications.

What is claimed is:

1. A method for recovering viscous oil from a subterranean, viscous oil-containing formation penetrated by at least one injection well and one production well and having fluid communication therebetween comprising:

a. establishing an in-situ combustion operation in the formation by injecting substantially pure oxygen into the formation via the injection well and recovering fluids including oil and an effluent gas from the formation via the production well;

b. continuously injecting nitrogen at a predetermined low injection rate into the lower portion of the production well;

c. continuously analyzing the effluent gas for oxygen concentration and monitoring the bottomhole temperature of the production well;

d. increasing said injection rate of said nitrogen gas to a maximum rate in the event the oxygen concentration of said effluent gas increases to a predetermined concentration or the bottomhole temperature increases to a predetermined temperature indicating a hazardous condition; and e. continuing injection of said nitrogen at a maximum rate until the oxygen concentration of the effluent gas and the bottomhole temperature are reduced to a safe level.

2. The method of claim 1 wherein the injection rate of the nitrogen is increased to a maximum rate when the oxygen content of the effluent gas is within the range of 5 to 20 volume percent or the bottomhole temperature of the production well is within the range of 200° to 300° F.

3. The method of claim 1 further including shutting-in the production well when the injection rate of the nitrogen is increased to a maximum rate.

4. The method of claim 1 wherein the injection rate of the nitrogen during step (b) is 0.1 to 2 MSCF/day.

5. A method for recovering viscous oil from a subterranean, viscous oil-containing formation penetrated by at least one injection well and one production well and having fluid communication therebetween comprising:

a. establishing an in-situ combustion operation in the formation by injecting substantially pure oxygen into the formation via the injection well and recovering fluids including oil and an effluent gas from the formation via the production well;

b. continuously injecting carbon dioxide at a predetermined low injection rate into the lower portion of the production well;

c. continuously analyzing the effluent gas for oxygen concentration and monitoring the bottomhole temperature of the production well;

d. increasing said injection rate of said carbon dioxide to a maximum rate in the event the oxygen concentration of said effluent gas increases to a predetermined concentration or the bottomhole temperature increases to a predetermined temperature indicating a hazardous condition; and e. continuing injection of said carbon dioxide at a maximum rate until the oxygen concentration of the effluent gas and the bottomhole temperature are reduced to a safe level.

6. The method of claim 5 wherein the injection rate of the carbon dioxide is increased to a maximum rate when the oxygen content of the effluent gas is within the range of 5 to 20 volume percent or the bottomhole temperature of the production well is within the range of 200° to 300° F.

7. The method of claim 5 further including shutting-in the production well when the injection rate of the carbon dioxide is increased to a maximum rate.

8. The method of claim 5 wherein the injection rate of the carbon dioxide during step (b) is 0.1 to 2 MSCF/day.

* * * * *